US007837276B2

(12) United States Patent
Kraemer et al.

(10) Patent No.: US 7,837,276 B2
(45) Date of Patent: Nov. 23, 2010

(54) CLOSE PROXIMITY GRINDER

(75) Inventors: Terrence L. Kraemer, St. Cloud, MN (US); Gerald Nestel, Sartell, MN (US)

(73) Assignee: Diamond Surface, Inc., Maple Grove, MN (US)

( * ) Notice: Subject to any disclaimer, the term of this patent is extended or adjusted under 35 U.S.C. 154(b) by 895 days.

(21) Appl. No.: 11/483,262

(22) Filed: Jul. 6, 2006

(65) Prior Publication Data

US 2008/0008527 A1 Jan. 10, 2008

(51) Int. Cl.
*E01C 23/09* (2006.01)

(52) U.S. Cl. ..... 299/39.6

(58) Field of Classification Search ..... 299/39.6, 299/39.3

See application file for complete search history.

(56) References Cited

U.S. PATENT DOCUMENTS

| | | | |
|---|---|---|---|
| 193,171 | A | 7/1877 | McRae |
| 894,269 | A | 7/1908 | Hendron |
| 995,974 | A | 6/1911 | Lewis |
| 1,791,668 | A | 2/1931 | Fox et al. |
| 2,244,742 | A | 6/1941 | Tyson |
| 2,502,043 | A | 3/1950 | Howard |
| 2,574,090 | A | 11/1951 | Dofsen |
| 2,791,442 | A | 5/1957 | Lee et al. |
| 2,826,128 | A | 3/1958 | Summers |
| 3,094,046 | A | 6/1963 | Zipelius |
| 3,104,600 | A | 9/1963 | White |
| 3,212,240 | A | 10/1965 | Streete |
| 3,407,005 | A | 10/1968 | Simms et al. |
| 3,529,517 | A | 9/1970 | Liddle et al. |
| 3,572,842 | A | 3/1971 | Mori |
| 3,605,579 | A | 9/1971 | Heltzel |
| 3,612,611 | A | 10/1971 | Ellis |
| 3,649,071 | A | 3/1972 | Graff |
| 3,702,093 | A | 11/1972 | Van de Loock et al. |
| 3,767,264 | A | 10/1973 | Eckey |
| 3,788,704 | A | 1/1974 | Staab |

(Continued)

FOREIGN PATENT DOCUMENTS

| | | |
|---|---|---|
| DE | 2 209 743 | 9/1973 |

(Continued)

OTHER PUBLICATIONS

Affidavit of Glenn Shed, 2 pages (executed Feb. 27, 2002).

(Continued)

*Primary Examiner*—John Kreck
(74) *Attorney, Agent, or Firm*—Merchant & Gould PC

(57) ABSTRACT

A close proximity pavement grinder is utilized for grinding close to a raised structure such as a lower surface of curbs close to the curb wall. The grinding apparatus utilizes a wide grinding head with grinding blades mounted along the length of an arbor to grind the lower surface of the curb in a single pass. The grinder includes a narrow bearing and support at the outer end of the arbor and is driven at the inner end so that the grinding may be conducted within close proximity of the curb wall. The grinder has a pivoting grinding head that can be locked at various angles relative to the grinder to match the relative angles between the pavement and the lower surface of the curb.

19 Claims, 7 Drawing Sheets

U.S. PATENT DOCUMENTS

| | | | | | |
|---|---|---|---|---|---|
| 3,801,211 | A | | 4/1974 | Perkins | |
| 3,868,146 | A | | 2/1975 | Ellis | |
| 3,874,806 | A | | 4/1975 | Grist et al. | |
| 3,901,553 | A | | 8/1975 | Binger et al. | |
| 3,929,377 | A | | 12/1975 | Weaver et al. | |
| 4,067,398 | A | | 1/1978 | Franzen et al. | |
| 4,174,184 | A | | 11/1979 | Heenan | |
| 4,346,766 | A | | 8/1982 | Manten | |
| 4,392,689 | A | | 7/1983 | Moore et al. | |
| 4,493,584 | A | | 1/1985 | Guntert | |
| 4,516,808 | A | | 5/1985 | Staab et al. | |
| 4,575,278 | A | | 3/1986 | Whitney | |
| 4,623,277 | A | | 11/1986 | Wayne et al. | |
| 4,701,069 | A | * | 10/1987 | Whitney | 404/75 |
| 4,792,190 | A | | 12/1988 | Bertrand | |
| 4,878,713 | A | * | 11/1989 | Zanetis | 299/39.5 |
| 4,885,012 | A | | 12/1989 | Thompson | |
| 4,900,094 | A | | 2/1990 | Sergeant | |
| 4,909,575 | A | | 3/1990 | Lupton | |
| 4,986,604 | A | | 1/1991 | Meister | |
| 5,078,540 | A | | 1/1992 | Jakob et al. | |
| 5,083,839 | A | | 1/1992 | Younger | |
| 5,092,658 | A | | 3/1992 | Smith | |
| 5,094,565 | A | | 3/1992 | Johnson | |
| 5,114,269 | A | | 5/1992 | Shepherd | |
| 5,190,398 | A | * | 3/1993 | Swisher, Jr. | 404/90 |
| 5,192,160 | A | | 3/1993 | Muehlstaedter | |
| 5,215,071 | A | | 6/1993 | Mertes et al. | |
| 5,297,894 | A | | 3/1994 | Yenick | |
| 5,354,146 | A | * | 10/1994 | O'Konek | 299/39.2 |
| 5,391,017 | A | | 2/1995 | Thomas et al. | |
| 5,484,228 | A | | 1/1996 | Thomas et al. | |
| 5,492,431 | A | | 2/1996 | Rasmussen et al. | |
| 5,582,490 | A | | 12/1996 | Murray | |
| 5,607,255 | A | | 3/1997 | Thomas et al. | |
| 5,676,490 | A | | 10/1997 | Nelson | |
| 5,857,453 | A | * | 1/1999 | Caven et al. | 125/13.01 |
| 6,116,699 | A | * | 9/2000 | Kaczmarski et al. | 299/39.5 |
| 6,206,478 | B1 | | 3/2001 | Uehara et al. | |
| 6,499,809 | B1 | | 12/2002 | O'Konek | |
| 6,565,282 | B1 | * | 5/2003 | Gray | 404/94 |
| 6,612,773 | B2 | | 9/2003 | Gray | |
| 7,073,975 | B2 | | 7/2006 | Kraemer | |

FOREIGN PATENT DOCUMENTS

| | | |
|---|---|---|
| DE | 3 200 862 | 7/1983 |
| EP | 0 283 286 A2 | 9/1988 |

OTHER PUBLICATIONS

Statement of Jeff Arnswald, 2 pages (executed Mar. 5, 2002).

"Devices to Prevent Run-Off-Road Accidents," *California State Department of Transportation, Sacramento Transportation Lab, U.S. Department of Commerce, National Technical Information Service*, 61 pages (Feb. 1976).

Exhibit A, International Grooving and Grinding Association brochure entitled, "Grooved Runways are Safer . . . Ground Runways are Easier on Aircraft," 8 pages (Apr. 1989).

Exhibit B, International Grooving and Grinding Association brochure entitled, "Grooving & Grinding are Cost Effective Ways to Restore Pavement Surfaces," 4 pages (prior art at least as early as Jul. 16, 1998).

Exhibit C, Target® PRM 3804 brochure, 2 pages (prior art at least as early as Jul. 16, 1998).

Exhibit D, Target Safetrac® Systems Rebuilding America's Infrastructure flyer, 2 pages (prior art at least as early as Jul. 16, 1998).

Exhibit E, Cushion Cut PC-5000 Highway Grinder brochure, 4 pages (prior art at least as early as Jul. 16, 1998).

* cited by examiner

CLOSE PROXIMITY GRINDER

BACKGROUND OF THE INVENTION

1. Field of the Invention

The present invention is directed to a grinding apparatus and method, and in particular to a pavement grinding apparatus and method for grinding close to curbs and other raised structures.

2. Description of the Prior Art

Pavement grinders are used for grinding concrete and asphalt surfaces to remove irregularities in the road surface, to provide texture to the surface to prevent skidding and to groove the surface to facilitate water drainage. Grinding, texturing and grooving are used on pavement surfaces including roads and streets, airport runways and bridge decks, industrial plants, stock pens and barns. The diamond tip blades that are used to grind the concrete or asphalt surfaces are mounted on a rotating arbor. Typical grinding machines have the arbor mounted on an under carriage so that both ends of the arbor are supported by bearing assemblies capable of sufficiently supporting the arbor while enduring the high stresses associated with pavement grinding. Both end portions of the arbor are typically mechanically driven by a system of belts and pulleys. Such grinders are large, heavy machines with sufficient mass to impart the high forces necessary for effective pavement grinding.

Smaller pavement saws are utilized to maintain expansion joints in the roadway and to separate damaged sections of pavement for easy removal. Such saws typically have a narrow cut and do not have sufficient power or mass for pavement grinding. Other specialized grinders are used to create slots for reflectors or to create rumble strips. Examples of grinders are shown in U.S. Pat. No. 5,354,146 assigned to Diamond Surface, Inc., and U.S. Pat. No. 5,161,910, also assigned to Diamond Surface, Inc. An example of a grinder for slot cutting is shown in U.S. Published Application 2005 0196240. Although these grinding and cutting devices have proven to be useful and efficient for their intended purposes, they are not suited for performing certain grinding functions.

Challenges exist for close proximity grinding by curbs and drains as most large grinders cannot get sufficiently close to the curb. A further problem compounding the difficulty in grinding close to curbs and drains is the angle between the lower apron or drainage portion to be ground next to the curb wall and the surface of the road or street. Often the road or street has a central crown and slopes slightly to the edges. The lower drainage apron portion of the curb also extends substantially horizontally, but typically the crown does not continue on to the apron portion of the curb. Therefore, the lower portion of a curb is tilted slightly relative to the adjacent road surface. This causes problems for grinding the lower apron portion of the curb as the grinder has an arbor extending at an angle to this lower surface rather than being parallel with the surface of the lower drainage portion of the curb, as is required for satisfactory grinding.

In addition, grinding such curbs presents problems with regard to grinder access. A common problem with such curbs is that a section of the drainage curb portion is slightly raised and/or offset, often leading to pooling and interrupting proper drainage. Transportation departments often require grinding to within a specified distance from the curb wall, typically 14-18 inches. Smaller prior art devices have not had the power and width to grind the surface of such portions in a satisfactory manner. The options have typically been to remove the section or to attempt to grind with smaller, hand maneuvered devices. Such manual devices have not been satisfactory, as the grinding is uneven and the process is too time-consuming and inefficient due to the grinding head being too narrow with insufficient power. The larger pavement grinding devices have arbors that do not get sufficiently close to the vertical portion of the curb to perform the grinding operation correctly. Such grinders typically have the arbor positioned on an under carriage and centered on the grinding device. Such an arrangement does not allow access to the curb to grind even a portion of the curb.

It can be seen then that a new and improved grinding apparatus is needed. Such a grinding apparatus should provide for a head having sufficient width and power to grind a curb. In addition, the head should be configured so that it can grind close enough to the raised curb portion to allow proper drainage. Such a device should also provide for changing the angle of the grinding head so that the grinder may be on a surface not aligned with the lower portion of the curb while grinding close to a raised structure. The present invention addresses these as well as other problems associated with close proximity grinding.

SUMMARY OF THE INVENTION

The present invention is directed to a close proximity grinder such as may be utilized for grinding close to the curb wall at the side of a road or street. The grinder includes a grinding head extending outward from the side of the grinder beyond the frame. The grinder includes conventional operating systems such as are found in other pavement grinders including an engine and a hydraulic fluid reserve. A water tank may be towed for providing a grinding slurry. The grinder also includes a vacuum system with a line leading to a shroud formed at the front of a grinder box surrounding the arbor on the grinding head. In one embodiment the grinder includes steerable front and rear wheels for improved maneuverability so as to closely follow the contour of the curb and maintain the grinding head over the desired grinding surface. Front and rear wheels may be coordinated to provide a tighter turning radius for a large pavement grinder than is possible with only front or rear wheel steering.

The grinding assembly is adjustable and mounted on plates driven and positioned by hydraulic cylinders to move up and down for the proper height. The grinding head is raised for travel and lowered for grinding operation. As curbs are generally oriented for drainage and tilted downward away from the surface of the road, for grinding the lower apron of curbs, it is necessary to have a grinding head that may be tilted. The grinding head of the present invention is mounted on a pivot plate movable about a pivot axis aligned substantially with an inner end of the grinding blades and tilted by a hydraulic cylinder. Three locking hydraulic cylinders mount in concentric slots centered about the pivot axis. The hydraulic cylinder extends to push the outer end of the grinding head downward and retracts to pull the outer end of the grinding head upward. The hydraulic locking cylinders are extended to release the pivot plate and are clamped down when the grinding head is oriented at the desired angle, generally parallel to the curb apron to be ground.

The grinding head includes an arbor driven only at the inboard end by a hydraulic motor. The arbor is also supported on a bearing block on the inner end and a narrow outer bearing. Grinding blades are mounted along the shaft of the arbor and provide a grinding face at least as wide as a typical curb. A grinder box surrounds the grinding head and incorporates the outer bearing into the end wall of the box. The grinding head also includes a vacuum shroud incorporated into the front wall of the grinder head and a spray bar extending to the rear of the blades of the grinding head. The grinding head is configured so that only a thin bearing is at the outer end of the cutting head. Therefore, little grinder structure extends beyond the outer end of the blades, and the grinding head may be positioned within close proximity of the wall portion extending upward from the lower apron portion of the curb. The grinding head can therefore grind to within a very close distance of raised structures as compared to prior designs, which were driven at both ends and may have vacuum and/or slurry water lines at an outer end of the grinding head.

In operation, the grinding head is raised for travel and lowered when grinding. The operator is seated so as to be placed directly behind the grinding head and can align the grinder head with the curb. To begin grinding, the grinding head is lowered with the hydraulic adjustment cylinders maintaining the grinding head at the desired height. The locking cylinders on the pivot plate are then released and the pivot cylinder is extended or retracted to match the grinding face of the arbor to the surface to be ground. The locking cylinders are then clamped down onto the pivot plate to maintain the grinding head at the proper position. The grinder is then advanced with the grinder head positioned close to the curb while grinding the upper surface of the curb in a single pass. The controls for the head and the grinder are within reach of the operator so that minor adjustments to angle, depth, speed and direction may be made by one operator without interrupting grinding. Therefore, the grinding may proceed continuously and the grinding head is sufficiently wide so that the entire width of the curb may be ground in a single pass.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numbers indicate corresponding structure throughout the several views.

DETAILED DESCRIPTION OF THE PREFERRED EMBODIMENT

Figure 1:
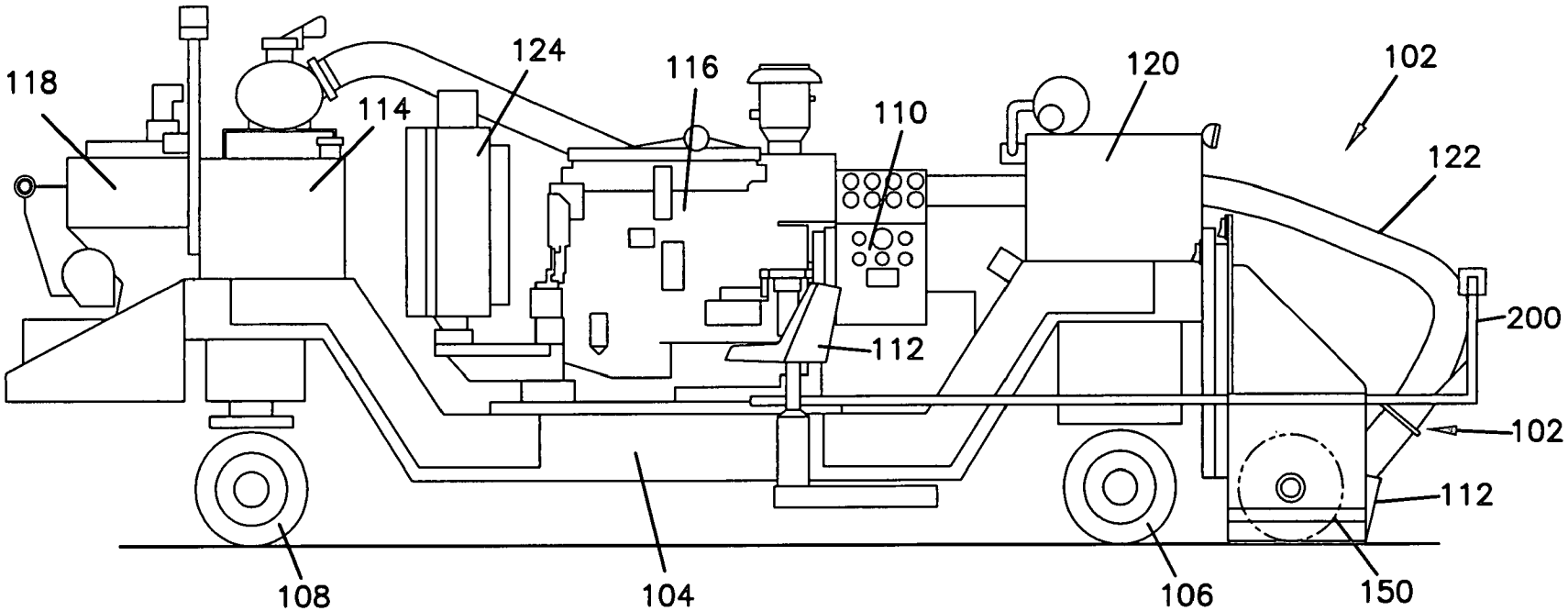
FIG. 1 is a right side elevational view of a close proximity grinder apparatus for use with curbs according to the principles of the present invention.

Referring now to the drawings and in particular to FIG. 1, there is shown a grinder, generally designated 100. The grinder 100 is configured for close proximity grinding by a laterally extending grinder assembly 102 and for grinding surfaces that are angled relative to the surface upon which the grinder 100 travels. Such grinding is needed for curbs at the edge of a road or street. The grinder 100 generally includes a frame 104 supported on front wheels 106 and rear wheels 108. In one embodiment, the front wheels 106 and rear wheels 108 are both steerable for improved maneuverability to closely follow a curb at the edge of the road. The front wheels 106 and rear wheels 108 may be steered in coordinated opposite directions for a tighter turning radius than is possible with other grinders and conventional two-wheel steering arrangements.

The grinder also has operational systems that are conventionally used with other types of pavement grinders. The grinder 100 includes an engine 116 providing power to the various powered systems of the grinder 100. A cyclone tank 118 connects by a vacuum line 122 to a grinding box 166 surrounding a grinding head 150. The grinder 100 also includes a hydraulic fluid reserve 120 for hydraulic motors and other hydraulically driven components and a radiator 124 to provide cooling. An operator sits on the right side of the grinder 100 in a seat 112 that allows the operator to view the grinding operation from directly behind the head 150. An alignment element extends forward and aids the operator in positioning the grinder 100 to follow the road and curb correctly. The operator seat 112 swivels in and out and positions the operator to operate the controls and to monitor gauges for various pumps, the blower for the vacuum, steering, tilt and clamping, as explained hereinafter, as well as grinder speed and head speed. It can be appreciated that the close proximity grinder 100 may be safely operated by one person with such an arrangement.

Figure 2:
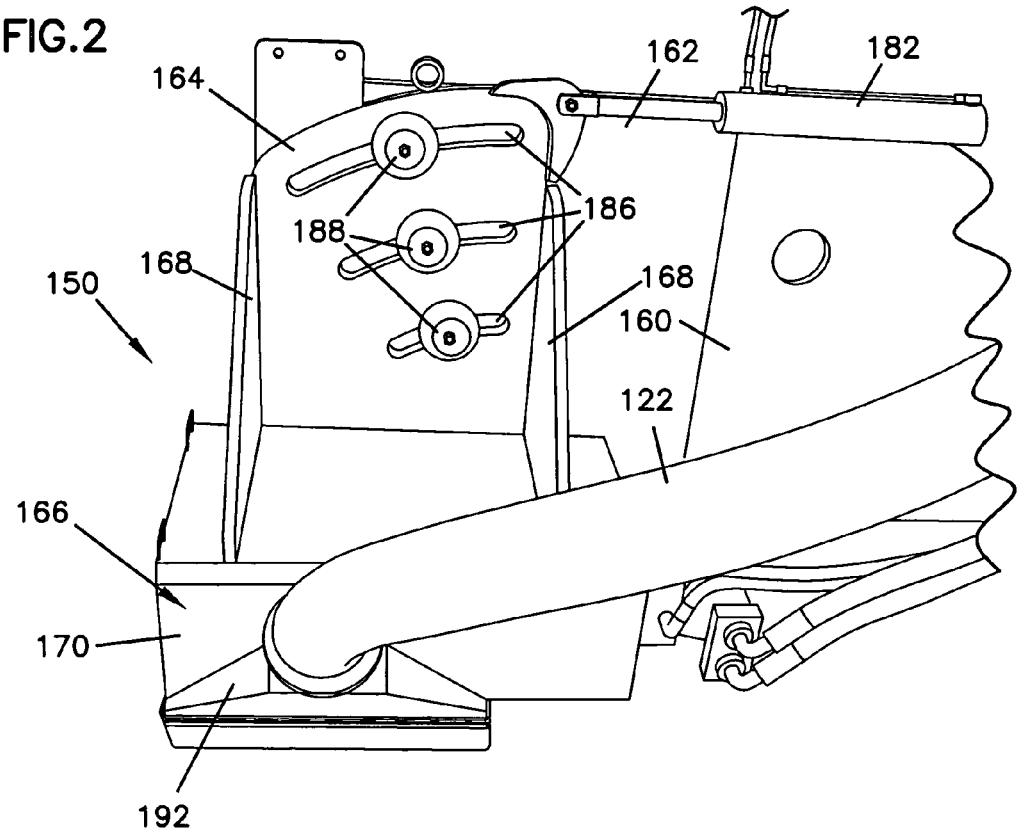
FIG. 2 is a front elevational view of the grinding assembly for the grinder apparatus shown in FIG. 1.
Figure 3:
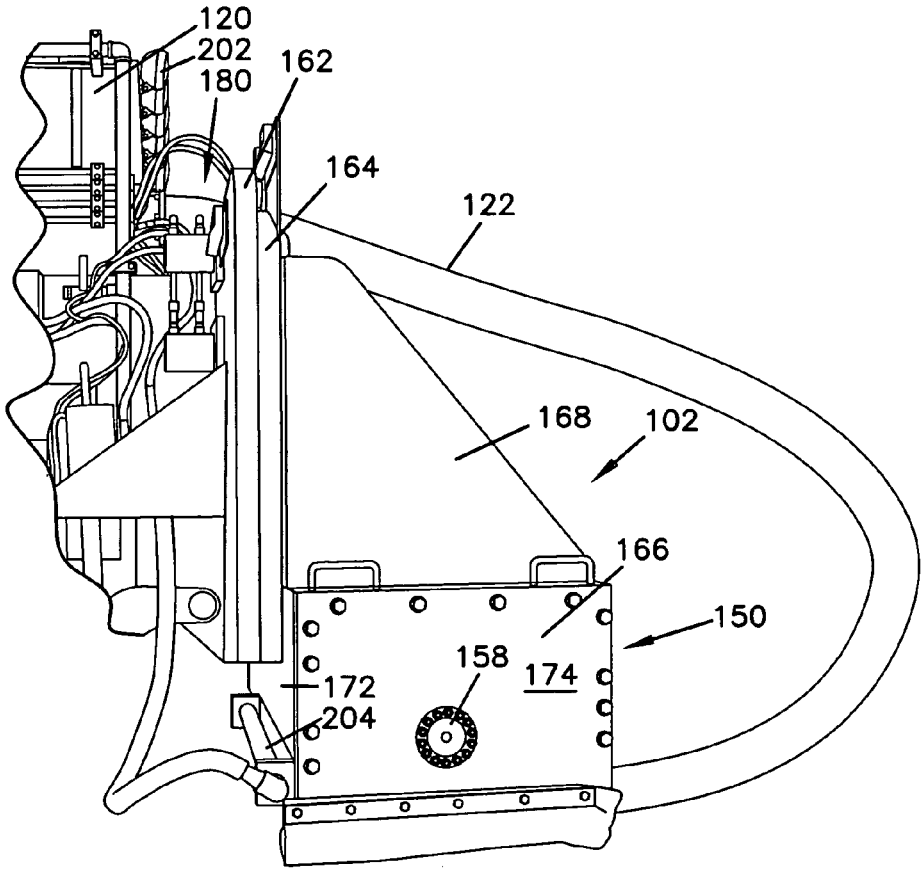
FIG. 3 is a right side elevational view of the grinding assembly shown in FIG. 2.

Referring now to FIGS. 2 and 3, the grinding assembly 102 is mounted at the front of the grinder 100 with the grinding head 150 extending outward beyond the grinder frame 104. The grinder assembly 102 includes the grinding head 150 having a rotating arbor 152, shown more clearly in FIGS. 5 and 6 and explained hereinafter. The grinding head 150 is mounted in the grinder box 166 that surrounds the rotating arbor 152 to minimize dust and debris. In addition, the vacuum line 122 leads to a shroud 192 extending across the front of the grinder box 166 and aligned with the width of the cutting blades. In this manner, the vacuum system can remove dust, water and other debris from the front of the grinding assembly 102 in close proximity to the grinding without limiting maneuverability next to raised structures, such as curbs. The grinder box 166 includes a front plate 170, a rear plate 172 and an end plate 174. The box 166 is supported by side plates 168 mounted on a pivot plate 164. The grinder box 166 includes a skirt 176 configured for dragging on the ground and providing a sealing between the box 166 and the ground during grinding so that dust and debris are contained in the grinder box 166.

As shown in FIG. 3, the grinding assembly 102 includes a spray bar 204 attached to a water line 206 at the rear of the grinder box 166. The spray bar 204 provides sprayed water to control dust and heat generated from the grinding operation. Moreover, it can be appreciated that with the shroud 192 at the front of the box 166 and the spray bar 204 at the rear of the grinder box 166 and extending across the width of the arbor, little end space is utilized by the grinding assembly 102, so that the grinder 100 may operate with the grinding head 150 in a close proximity to curbs and other objects along the side of the pavement. Moreover, the system allows for more efficient direct spraying and dust control than is possible with side mounted spray and/or vacuum systems and also provides for more even distribution of the water and removal of the dust, water and debris.

As shown in FIG. 2, the grinding head 150 mounts on a pivot plate 164 attaching to a vertically movable plate 162. The plate 162 is mounted to move up and down and is controlled by hydraulic cylinders 180 (hidden in FIG. 3). The grinding head 150 can be moved by raising and lowering the plate 162 between a raised travel position and a lowered operating position. A wheel assembly 178 is mounted to the rear of the grinder head 150 and aids in positioning the grinder head 150 at the optimal grinding height.

Figure 4:
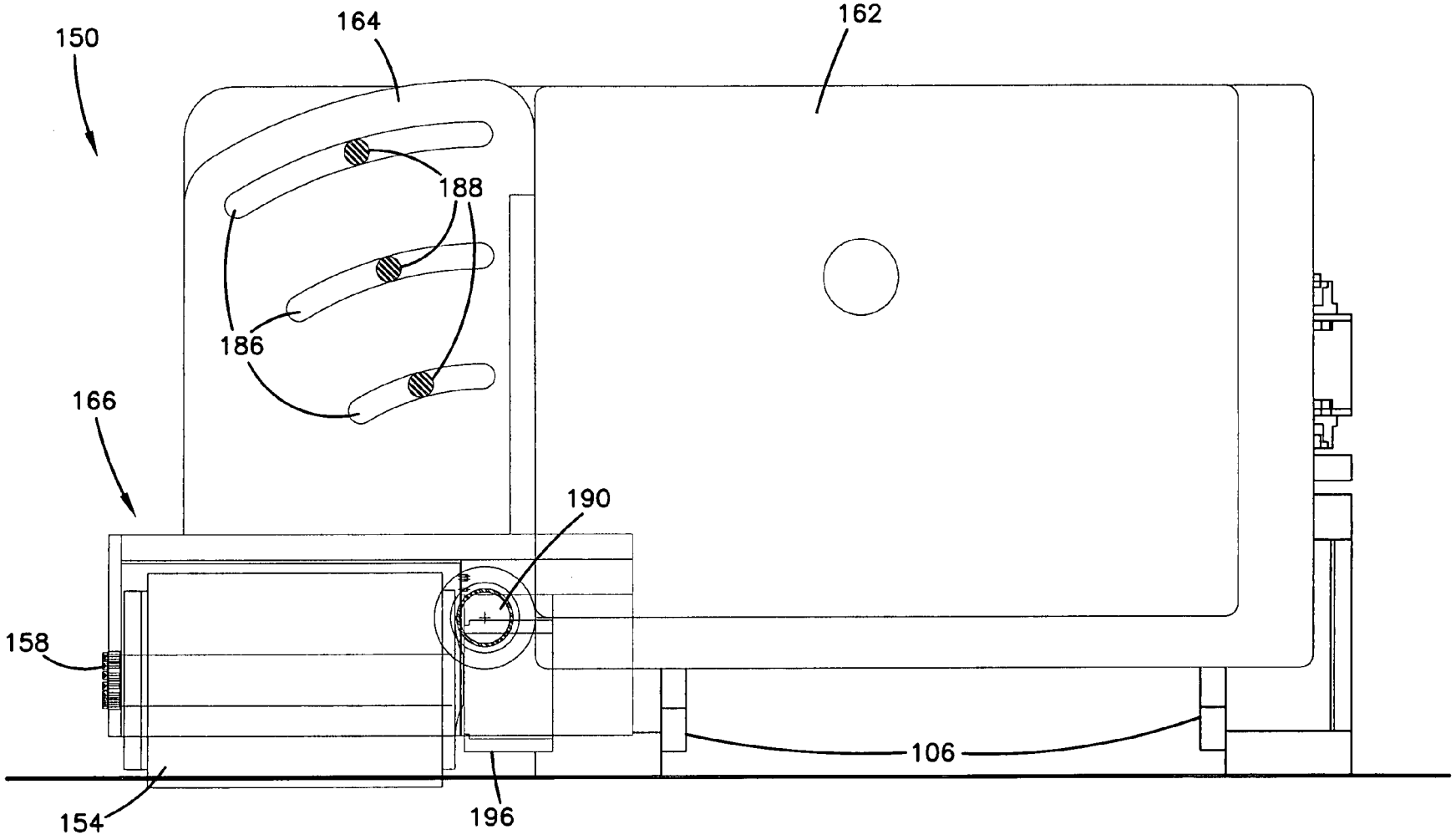
FIG. 4 is a front elevational view of the grinding arbor and mounting structure for the grinding assembly shown in FIG. 2.

In addition to a controlled vertical position, the angle of the grinding head 150 may be varied. The grinding head 150 is attached to the pivot plate 164. The pivot plate 164 includes three concentric slots 186. The slots 186 are centered about a pivot axis 190, as shown in FIG. 4. Locking hydraulic cylinders 188 can be clamped to retain the pivot plate 164 and the grinding head 150 at a desired angle. The slots are configured so that the head has an adjustment of 16 degrees relative to horizontal for a total tilt of 32 degrees. The angular position is changed by extending and retracting a tilt cylinder 182 mounted to the pivot plate 164. Extension of the hydraulic tilt cylinder 182 tilts the pivot plate 164 and the outer end downward. Retracting the tilt cylinder 182 pulls the pivot plate 164 inward and tilts the outer end of the grinder head 150 upward. When the desired position is achieved, the pivot plate 164 can be locked into position by closing the locking cylinders 188 to clamp the plates 162 and 164 in a locked engagement.

Figure 5:
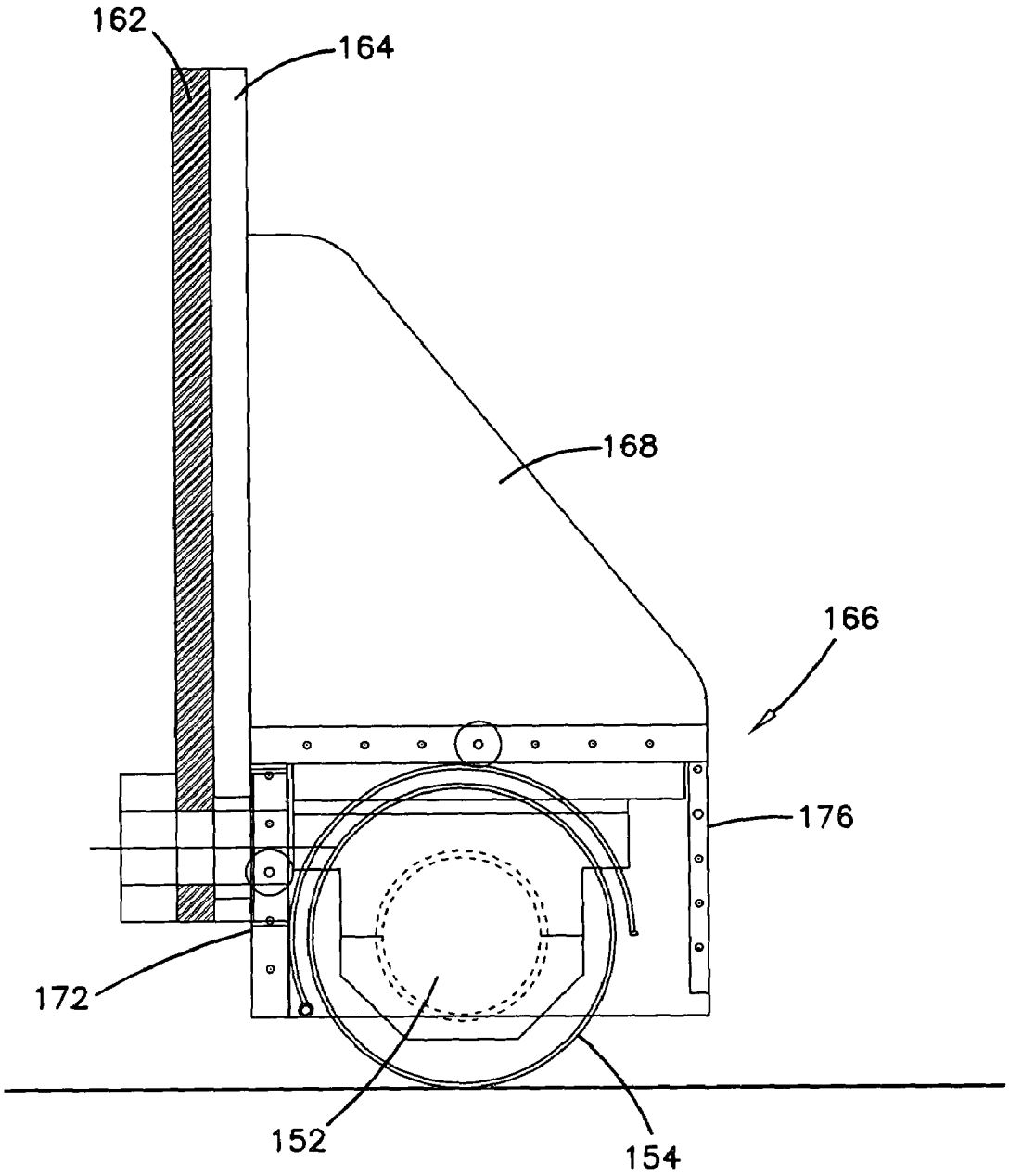
FIG. 5 is a side elevational view with portions removed of the grinding arbor shown in FIG. 4.
Figure 6:
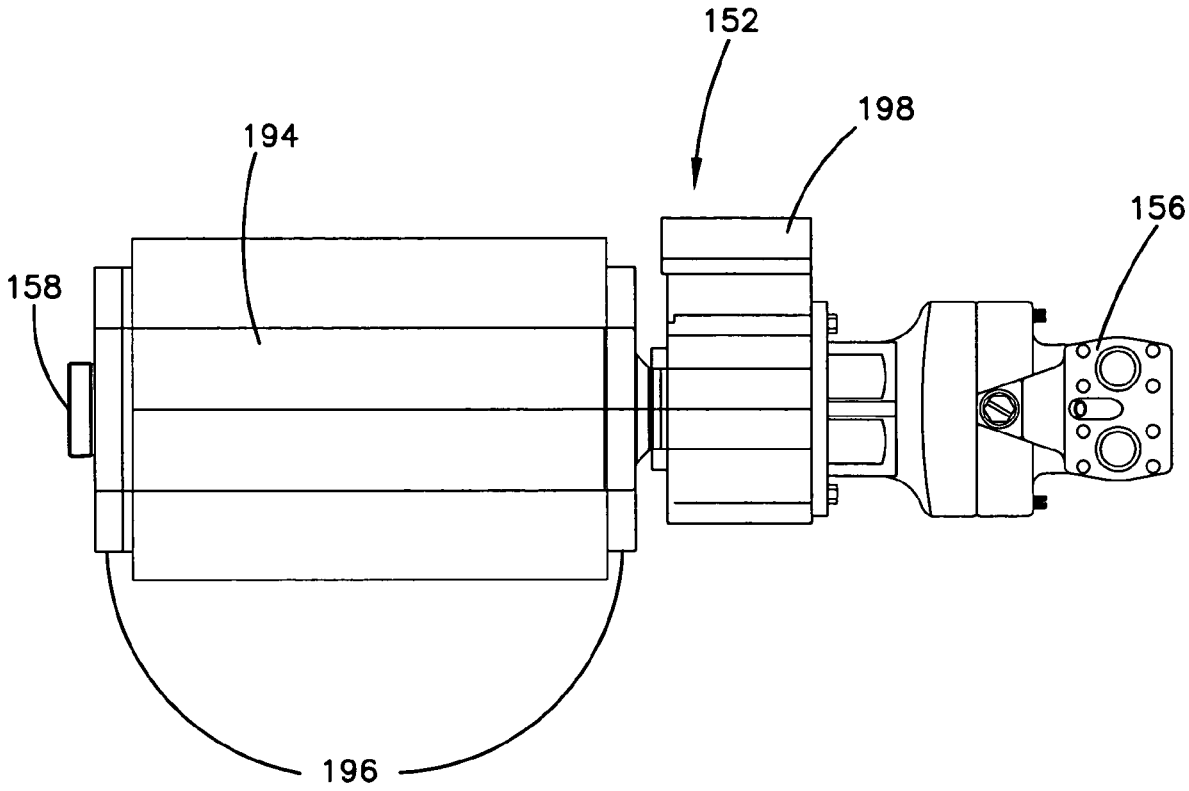
FIG. 6 is a front elevational view of the grinding arbor and drive for the grinding assembly shown in FIG. 2.

Referring now to FIGS. 5 and 6, the grinder head 150 is shown in greater detail. As shown in FIG. 5, the grinder box 166 surrounds the arbor 152. As shown in FIG. 6, the arbor 152 includes a central shaft 194 having radially outward extending end portions 196. Rotary diamond tipped blades 154 are positioned in a stack along the length of the mounting portion 194. The outer end of the arbor 152 includes a very narrow support bearing 198. The hydraulic drive motor 156 is on the inner end of the arbor 152, as also shown in FIG. 2. A bearing block 198 supports the inner end of the arbor 152 between the drive motor 156 and the blades 154. It can be appreciated that with this arrangement, the outer end of the grinding head 150 may be positioned very closely to raised structures such as curbs, which is not possible with other pavement grinding devices, which have a wide bearing, hydraulic or pneumatic lines and/or a drive motor or belt at the outer end of the arbor.

Moreover, the grinder 100 can provide sufficient power and weight to perform grinding operations on curbs and other devices that were not possible with lighter weight grinders. The grinding head is approximately two feet wide so that grinding of curbs can typically be performed with a single pass. This also increases efficiency over hand operated devices which can only grind small, narrow areas at one time. Therefore, several passes were needed and the surface may not be ground to an even depth. Therefore, a single pass improves both speed and quality over such smaller devices.

Figure 8:
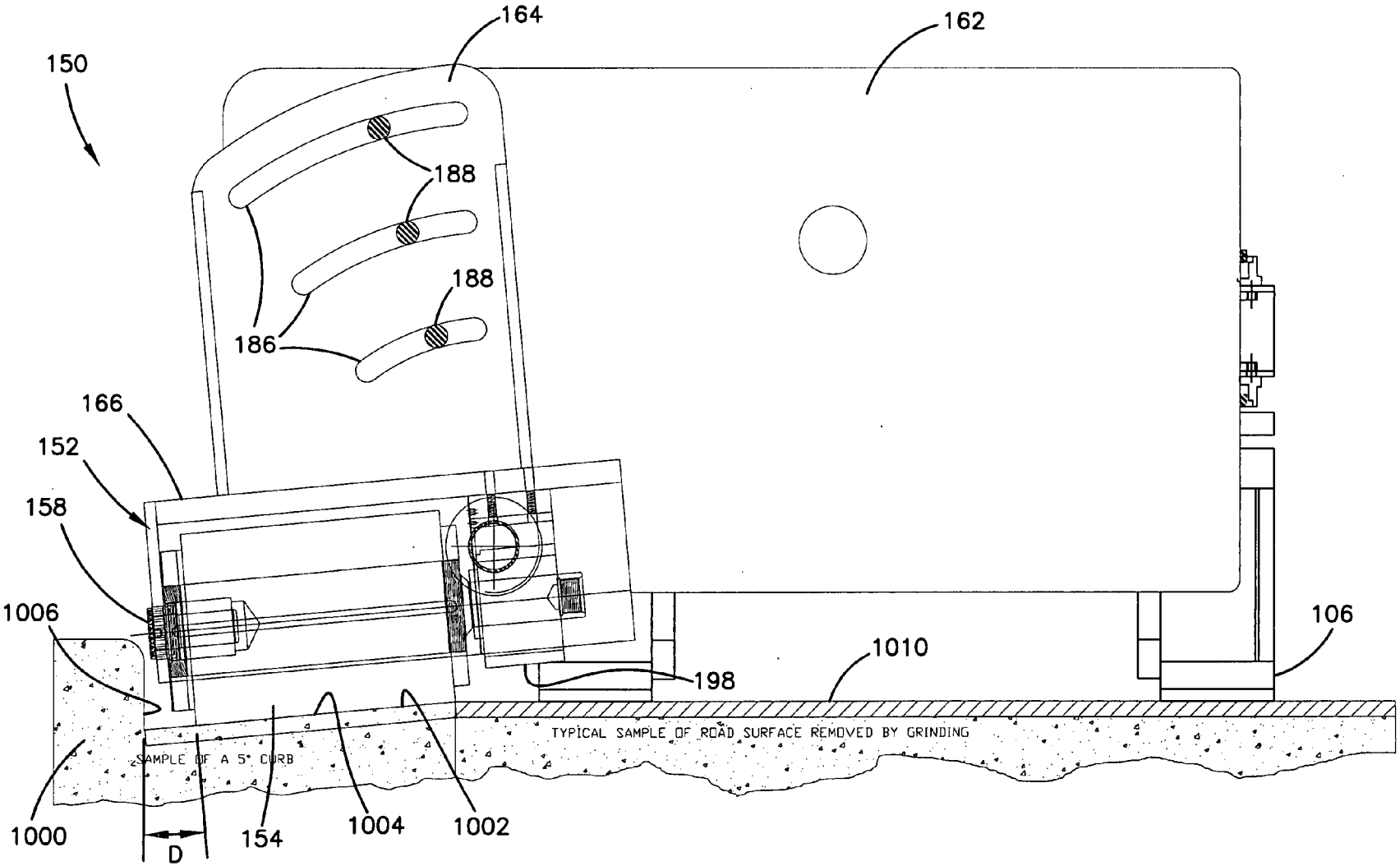
FIG. 8 is a front view of a curb and the grinding head shown in FIG. 2 lowered and angled for grinding a curb.

Referring now to FIG. 8, typical positioning of the grinding head 150 is shown. In a typical roadway, the road surface 1010 is substantially horizontal or may even have a slight crown. A curb 1000 is positioned at the side of the roadway and typically has a slight angle indicated by angle "A" sloping downward from the surface of the road 1010. The curb usually includes a raised wall portion 1006 and a lower apron portion 1002. The grinding area 1004 extends to within a distance "D" of the wall portion 1006. The distance D is much less than the distance required by transportation departments when specifying grinding requirements for curbs.

Figure 7:
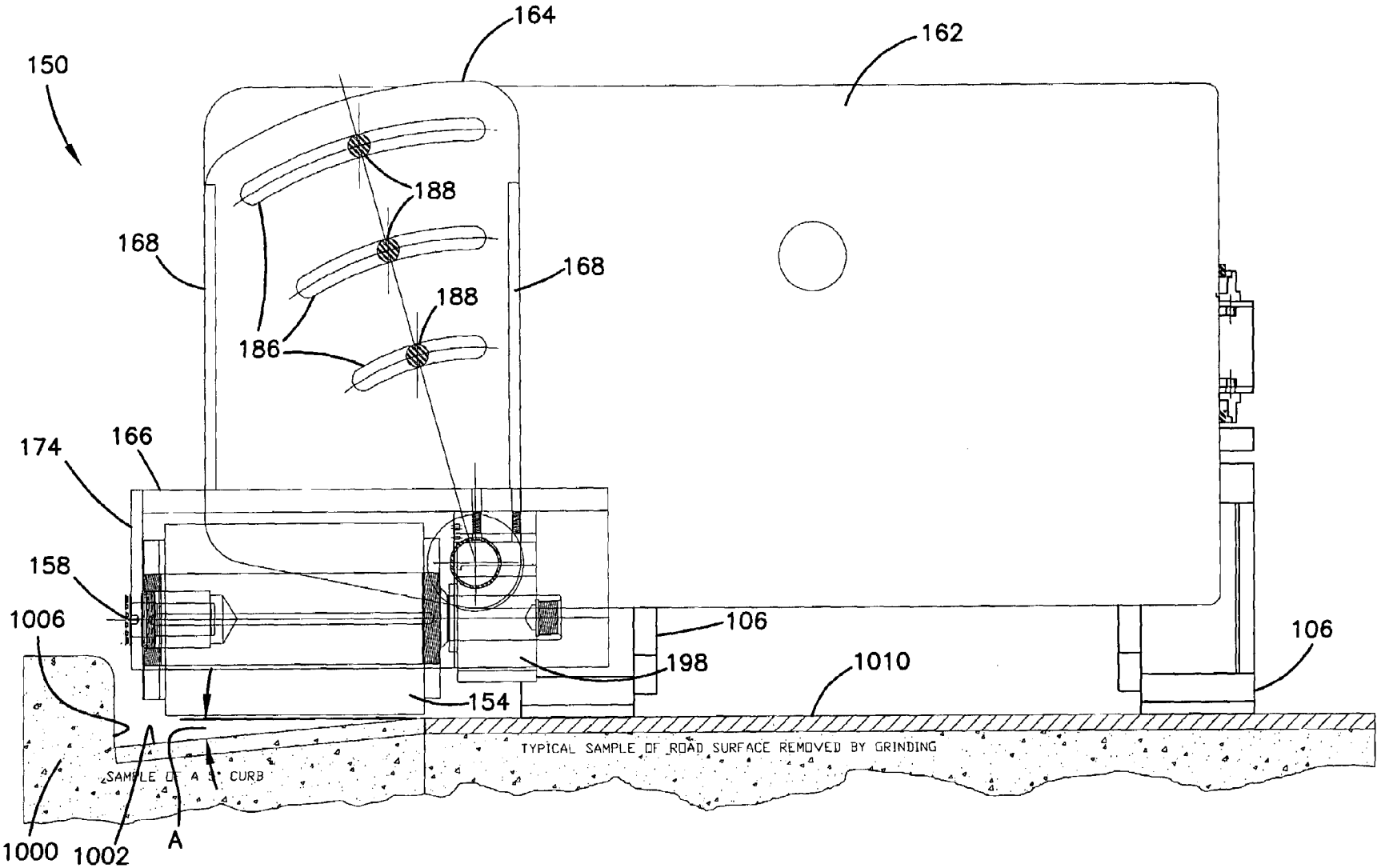
FIG. 7 is a front elevational view of the grinding assembly shown in FIG. 2 in a raised position for travel.

As shown in FIG. 7, when the grinder is in a transport configuration, the grinding head 150 is raised up away from the pavement 1010 and the curb 1000. The grinding head 150 is raised by retracting the cylinders 180 of FIG. 3.

To perform grinding, the grinding head 150 must be moved to the grinding position as shown in FIG. 8. To accomplish this, the grinding assembly 150 is lowered by extending the cylinders 180. The grinding head 150 is then tilted to the correct angle. To accomplish correct angle position, the lock cylinders 188 are extended and unclamped, thereby loosening the pivot plate 164 and allowing the pivot plate 164 to be moved. The pivot cylinder 182 is then extended or retracted until the arbor 152 is positioned parallel to the grinding area 1004 of the curb 1000. The hydraulic lock cylinders 188 are then clamped onto the pivot plate 164 to hold the arbor 152 at the desired grinding position. The grinder assembly 102 may then be actuated for performing grinding operation. Minor adjustments to height for controlling the grinding depth may be made by the operator. Grinding continues with the operator seated directly behind the grinding head 150 and utilizing the alignment element 200 to maintain the grinder 100 and the grinding head 150 at the proper distance from the curb wall 1006 and properly aligned with the roadway to grind the desired area. It can be appreciated that the grinding head 150 having blades 154 extending for two feet is wider than standard curbs so that the grinding may be conducted in a single pass. Moreover, only a single lane of traffic is required for the grinding operation so that traffic may continue without blocking a second lane.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A close proximity pavement grinding apparatus, comprising:

a frame;

wheels supporting the frame;

a grinding head support assembly mounted laterally outward from the frame and wheels;

a grinding head mounted to the grinding head support assembly having an arbor with a first end and a second end and having a plurality of blades mounted along the arbor;

a grinding head motor at the first end of the grinding head and imparting rotation to the grinding head;

a bearing supporting the second end of the grinding head;

wherein the grinding head extends laterally from one side of the grinding apparatus beyond the frame and wheels, the grinding head pivoting about a pivot axis above the blades at the first end of the grinding head, the pivot axis being laterally inward and transverse to the arbor and laterally outward beyond the frame and wheels;

wherein the grinding head support assembly comprises locking pins engaging slots to position the grinding head at a predetermined angle relative to the pavement, wherein the slots comprise concentric arcs over the grinding head and centered about the pivot axis and having inner ends that are vertically aligned above the pivot axis when the grinding head is in a horizontal position.

2. A pavement grinding apparatus according to claim 1, wherein the grinding head support assembly is movable horizontally while operating.

3. A pavement grinding apparatus according to claim 1, wherein the grinding head support assembly comprises locking hydraulic cylinders to control pivoting movement.

4. A pavement grinding apparatus according to claim 1, wherein the grinding head support assembly comprises locking hydraulic cylinders and locking pins to control horizontal movement.

5. A pavement grinding apparatus according to claim 1, further comprising a slurry removal system positioned laterally outward from the frame and wheels and forward of the grinding head support assembly.

6. A pavement grinding apparatus according to claim 5, wherein the slurry removal system is laterally centered on the grinding head.

7. A pavement grinding apparatus according to claim 1, wherein the apparatus includes at least two front wheels and at least two rear wheels.

8. A pavement grinding apparatus according to claim 1, wherein the apparatus includes all wheel steering.

9. A pavement grinding apparatus according to claim 1, wherein the apparatus includes selectable steering from the front wheels and/or the rear wheels.

10. A pavement grinding apparatus according to claim 1, wherein the grinding head comprises an arbor support at an extended end, the arbor support having a width substantially less than the width of the plurality of blades.

11. A pavement grinding apparatus according to claim 1, wherein the grinding head comprises a plurality of locking pins sliding in arcing slots centered about a pivot point above the outer edge.

12. A close proximity pavement grinding apparatus, comprising:

a chassis;

front wheels and at least one rear wheel supporting the chassis;

a grinding head support assembly mounted to the chassis laterally outward from the chassis and wheels;

a grinding head mounted to the grinding head support assembly in front of the front wheels and extending laterally from one side of the grinding apparatus having an arbor with a plurality of blades mounted along the arbor, the arbor being positioned laterally outward from the chassis and wheels;

a grinding head drive attached at the first end of the grinding head on the grinding head support assembly imparting rotation to the grinding head;

a bearing supporting the second end of the grinding head;

wherein the grinding head pivots about a pivot axis above the blades at the first end of the grinding head, wherein the pivot axis is laterally inward and transverse to the arbor and laterally outward beyond the chassis and wheels;

wherein the grinding head support assembly comprises locking pins engaging slots to position the grinding head at a predetermined angle relative to the pavement, wherein the slots comprise concentric arcs over the grinding head and centered about the pivot axis and having inner ends that are vertically aligned above the pivot axis when the grinding head is in a horizontal position.

13. A pavement grinding apparatus according to claim 1, wherein the grinding head support assembly comprises extendible hydraulic cylinders for positioning and holding the grinding head.

14. A pavement grinding apparatus according to claim 1, further comprising an operator seat positioned at a side of the frame nearest the grinding head and behind the grinding head.

15. A pavement grinding apparatus according to claim 12, further comprising an operator seat positioned at a side of the chassis nearest the grinding head and behind the grinding head.

16. A pavement grinding apparatus according to claim 1, wherein the locking pins are aligned radially outwardly from the pivot axis.

17. A pavement grinding apparatus according to claim 1, wherein each of the locking pins is at a midpoint of a corresponding slot.

18. A pavement grinding apparatus according to claim 12, wherein the locking pins are aligned radially outwardly from the pivot axis.

19. A pavement grinding apparatus according to claim 12, wherein each of the locking pins is at a midpoint of a corresponding slot.

* * * * *